US008746690B1

(12) United States Patent
Rao et al.

(10) Patent No.: US 8,746,690 B1
(45) Date of Patent: Jun. 10, 2014

(54) DUPLEXING UNIT WITH FREELY ROTATABLE CONTACT SURFACE

(71) Applicants: Venkatesh Mysore Nagaraja Rao, Singapore (SG); Ang Beng Keong, Singapore (SG)

(72) Inventors: Venkatesh Mysore Nagaraja Rao, Singapore (SG); Ang Beng Keong, Singapore (SG)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/742,602

(22) Filed: Jan. 16, 2013

(51) Int. Cl.
*B65H 5/00* (2006.01)

(52) U.S. Cl.
USPC ..... 271/225; 271/184; 271/186; 399/364

(58) Field of Classification Search
USPC ..... 271/225, 184, 186, 264; 399/401, 374, 399/364
See application file for complete search history.

(56) References Cited

U.S. PATENT DOCUMENTS

| | | | | |
|---|---|---|---|---|
| 7,350,902 | B2 | 4/2008 | Dietl et al. | |
| 7,561,823 | B2 | 7/2009 | Johnson et al. | |
| 7,794,078 | B2 * | 9/2010 | Coenen et al. | 347/104 |
| 2011/0241279 | A1 * | 10/2011 | Sonoda et al. | 271/109 |
| 2012/0306978 | A1 | 12/2012 | Chuang et al. | |

FOREIGN PATENT DOCUMENTS

JP 01117153 A * 5/1989

* cited by examiner

*Primary Examiner* — Luis A Gonzalez
(74) *Attorney, Agent, or Firm* — Peyton C. Watkins

(57) ABSTRACT

A duplexing unit for reversing an orientation of a sheet in an imaging apparatus, the duplexing unit includes an outer member including an inner surface; and an inner member that is housed within the outer member, the inner member including: a stationary structural element having an outer surface with a radius of curvature; and a freely rotatable element having a radius that is larger than the radius of curvature of the stationary structural element, wherein a duplexing path is provided between the inner surface of the outer member and a contact surface of the freely rotatable element.

9 Claims, 15 Drawing Sheets

DUPLEXING UNIT WITH FREELY ROTATABLE CONTACT SURFACE

CROSS REFERENCE TO RELATED APPLICATIONS

Reference is made to commonly assigned U.S. patent application Ser. No. 13/742,618 filed Jan. 16, 2013 by Venkatesh Rao and Beng Keong Ang, entitled "Duplexing Unit with Low Friction Media Guide".

FIELD OF THE INVENTION

The present invention generally relates to a media path for an imaging apparatus, and more particularly to a duplexing unit for reversing a side of the media.

BACKGROUND OF THE INVENTION

Many types of printing apparatus are capable of printing only on a single side of the recording medium. However, the desirability of saving paper (or other types of recording medium) by printing on both sides is widely recognized. A variety of duplexing designs have previously been disclosed for reversing a side of the recording medium facing the print region after a first side has been printed, in order to allow printing on the opposite side. Duplexing units are common, not only in printers but also in other types of imaging apparatus, such as scanners.

In some low-cost printers, as described in U.S. Pat. No. 7,561,823, a duplexing unit is provided as a removable auxiliary unit that the user can decide whether or not to purchase, according to his printing needs. As disclosed in U.S. Pat. No. 7,561,823, if the duplexing unit does not include any rollers, so that the rollers in the main body of the printer provides the power to push the media through the duplexing unit, no electrical or mechanical power needs to be provided to the duplexing unit, and no mechanical moving parts are needed within the removable duplexing unit.

However, it has been found that for passive duplexing units, such as those described in U.S. Pat. No. 7,561,823 or US Patent Publication 2012/0306978, sheets of recording medium, such as photo media, that are thicker than about 0.15 mm are susceptible to binding in the duplexing unit, thereby causing paper jams. This is especially true if the wrap angle of the recording medium in the duplexing unit is greater than about 180 degrees.

What is needed is a duplexing unit for an imaging apparatus that is configured to facilitate reliable passage of recording medium through the duplexing unit without binding.

SUMMARY OF THE INVENTION

A duplexing unit for reversing an orientation of a sheet in an imaging apparatus, the duplexing unit comprising: an outer member including an inner surface; and an inner member that is housed within the outer member, the inner member including: a stationary structural element having an outer surface with a radius of curvature; and a freely rotatable element having a radius that is larger than the radius of curvature of the stationary structural element, wherein a duplexing path is provided between the inner surface of the outer member and a contact surface of the freely rotatable element.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

While the specification concludes with claims particularly pointing out and distinctly claiming the subject matter of the present invention, it is believed that the invention will be better understood from the following description when taken in conjunction with the accompanying drawings, wherein:

DETAILED DESCRIPTION OF THE INVENTION

Figure 1:
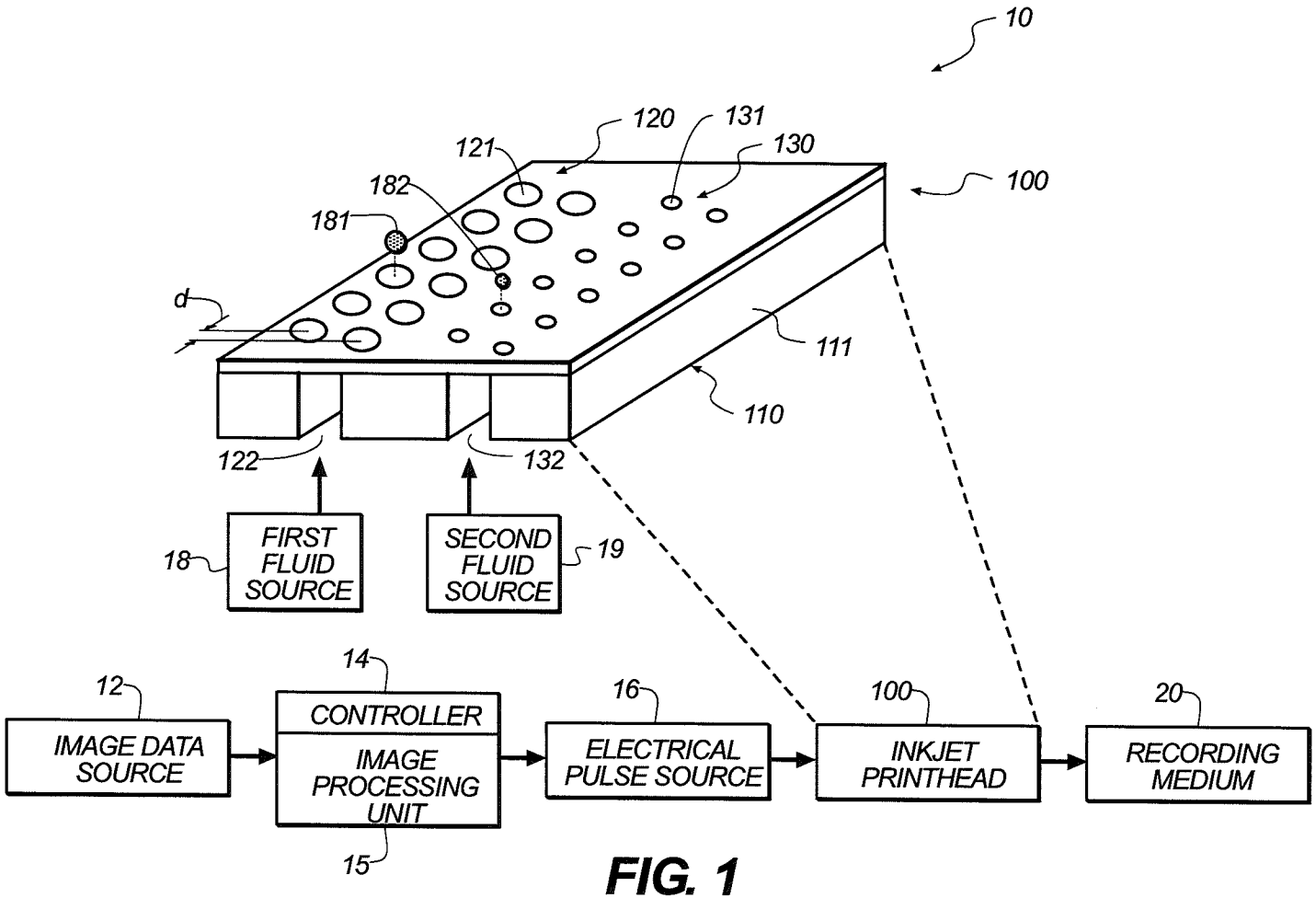
FIG. 1 schematically shows an inkjet printer system.

Referring to FIG. 1, a schematic representation of an inkjet printer system 10 is shown, for its usefulness with the present invention and is fully described in U.S. Pat. No. 7,350,902, and is incorporated by reference herein in its entirety. The inkjet printer system 10 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

Figure 2:
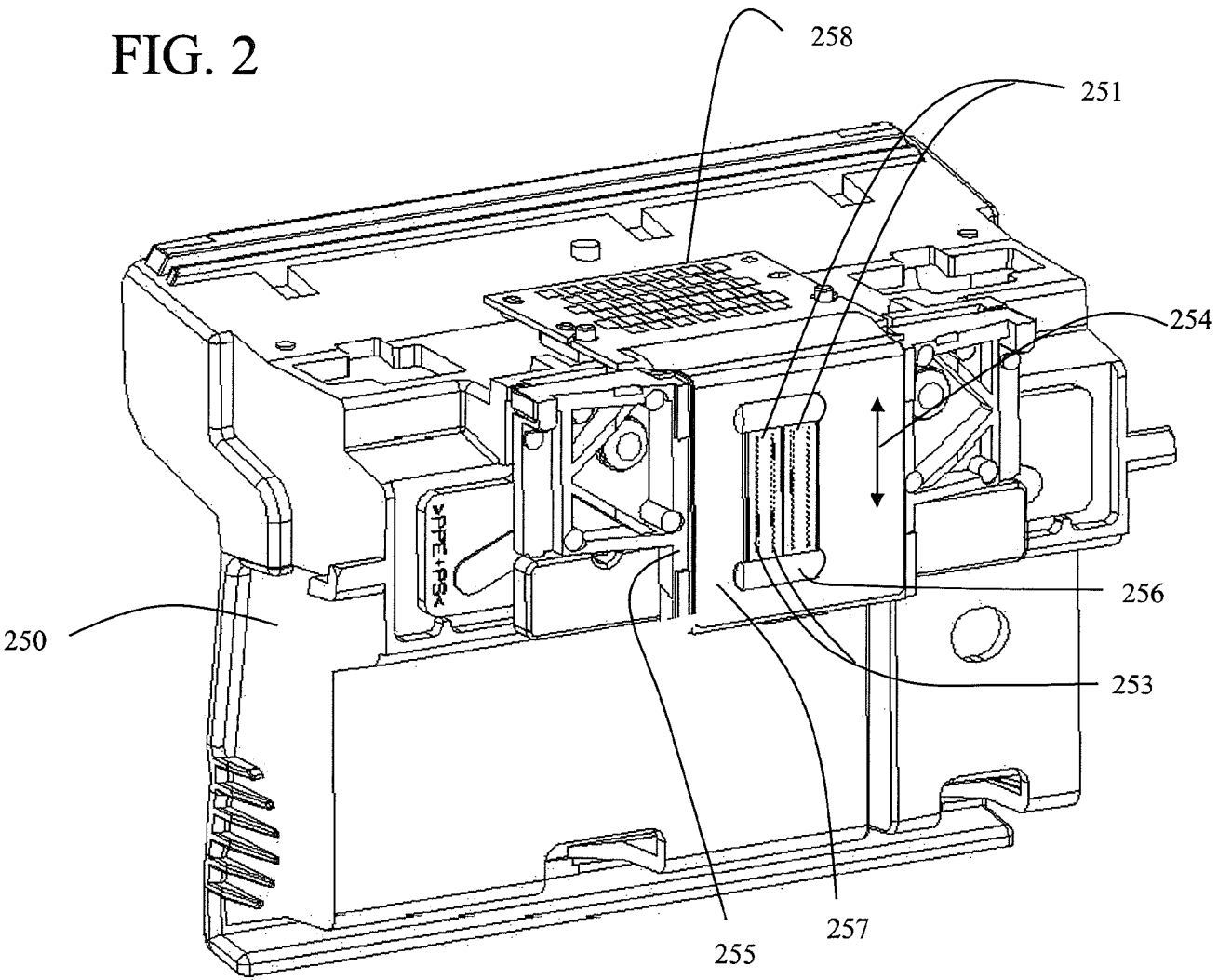
FIG. 2 is a perspective of a printhead.

In the example shown in FIG. 1, there are two nozzle arrays 120 and 130 that are each disposed along a nozzle array direction 254 (see FIG. 2). Nozzles 121 in the first nozzle array 120 have a larger opening area than nozzles 131 in the second nozzle array 130. In this example, each of the two nozzle arrays 120 and 130 has two staggered rows of nozzles 121 and 131, each row having a nozzle density of 600 per inch. The effective nozzle density then in each nozzle array 120 and 130 is 1200 per inch (i.e. $d=1/1200$ inch in FIG. 1). If pixels on a recording medium 20 were sequentially numbered along the paper advance direction, the nozzles 121 and 131 from one row of an array 120 and 130 would print the odd numbered pixels, while the nozzles 121 and 131 from the other row of the array 120 and 130 would print the even numbered pixels.

In fluid communication with each nozzle array 120 and 130 is a corresponding ink delivery pathway 122 and 132. The ink delivery pathway 122 is in fluid communication with the first nozzle array 120, and the ink delivery pathway 132 is in fluid communication with the second nozzle array 130. Portions of ink delivery pathways 122 and 132 are shown as openings through a printhead die substrate 111. One or more inkjet printhead die 110 will be included in the inkjet printhead 100, but for greater clarity only one inkjet printhead die 110 is shown in FIG. 1. The inkjet printhead die 110 are arranged on a mounting support member as discussed below relative to FIG. 2. In FIG. 1, a first fluid source 18 supplies ink to the first nozzle array 120 via the ink delivery pathway 122, and a second fluid source 19 supplies ink to the second nozzle array 130 via the ink delivery pathway 132. Although distinct first and second fluid sources 18 and 19 are shown, in some applications it may be beneficial to have a single fluid source supplying ink to both the first nozzle array 120 and the second nozzle array 130 via ink delivery pathways 122 and 132, respectively. Also, in some embodiments, fewer than two or more than two nozzle arrays 120 and 130 can be included on the inkjet printhead die 110. In some embodiments, all nozzles 121 and 131 on inkjet printhead die 110 can be the same size, rather than having multiple sized nozzles 121 and 131 on the inkjet printhead die 110.

The drop forming mechanisms associated with the nozzles are not shown in FIG. 1. The drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from the electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with the nozzle arrays 120 and 130 are also sized differently in order to optimize the drop ejection process for the different sized drops. During operation, droplets of ink 181 and 182 are deposited on the recording medium 20 (also referred to herein as paper, print medium or medium).

FIG. 2 shows a perspective of a portion of a printhead 250, which is an example of the inkjet printhead 100. The printhead 250 includes two printhead die 251 (similar to inkjet printhead die 110 of FIG. 1) that are affixed to a common mounting support member 255. Each printhead die 251 contains two nozzle arrays 253, so that the printhead 250 contains four nozzle arrays 253 altogether. The four nozzle arrays 253 in this example can each be connected to separate ink sources. Each of the four nozzle arrays 253 is disposed along the nozzle array direction 254, and the length of each nozzle array 253 along nozzle array direction 254 is typically on the order of 1 inch or less. Typical lengths of recording media 20 are 6 inches for photographic prints (4 inches by 6 inches) or 11 inches for paper (8.5 by 11 inches). Thus, in order to print a full image, a number of swaths are successively printed while moving the printhead 250 across the recording medium 20. Following the printing of a swath, the recording medium 20 is advanced along a media advance direction that is substantially parallel to the nozzle array direction 254.

Also shown in FIG. 2 is a flex circuit 257 to which the printhead die 251 are electrically interconnected, for example, by wire bonding or TAB bonding. The interconnections are covered by an encapsulant 256 to protect them. The flex circuit 257 bends around a side of the printhead 250 and connects to a connector board 258. When the printhead 250 is mounted into a carriage 200 (see FIG. 3), the connector board 258 is electrically connected to a connector (not shown) on the carriage 200 so that electrical signals can be transmitted to the printhead die 251.

Figure 3:
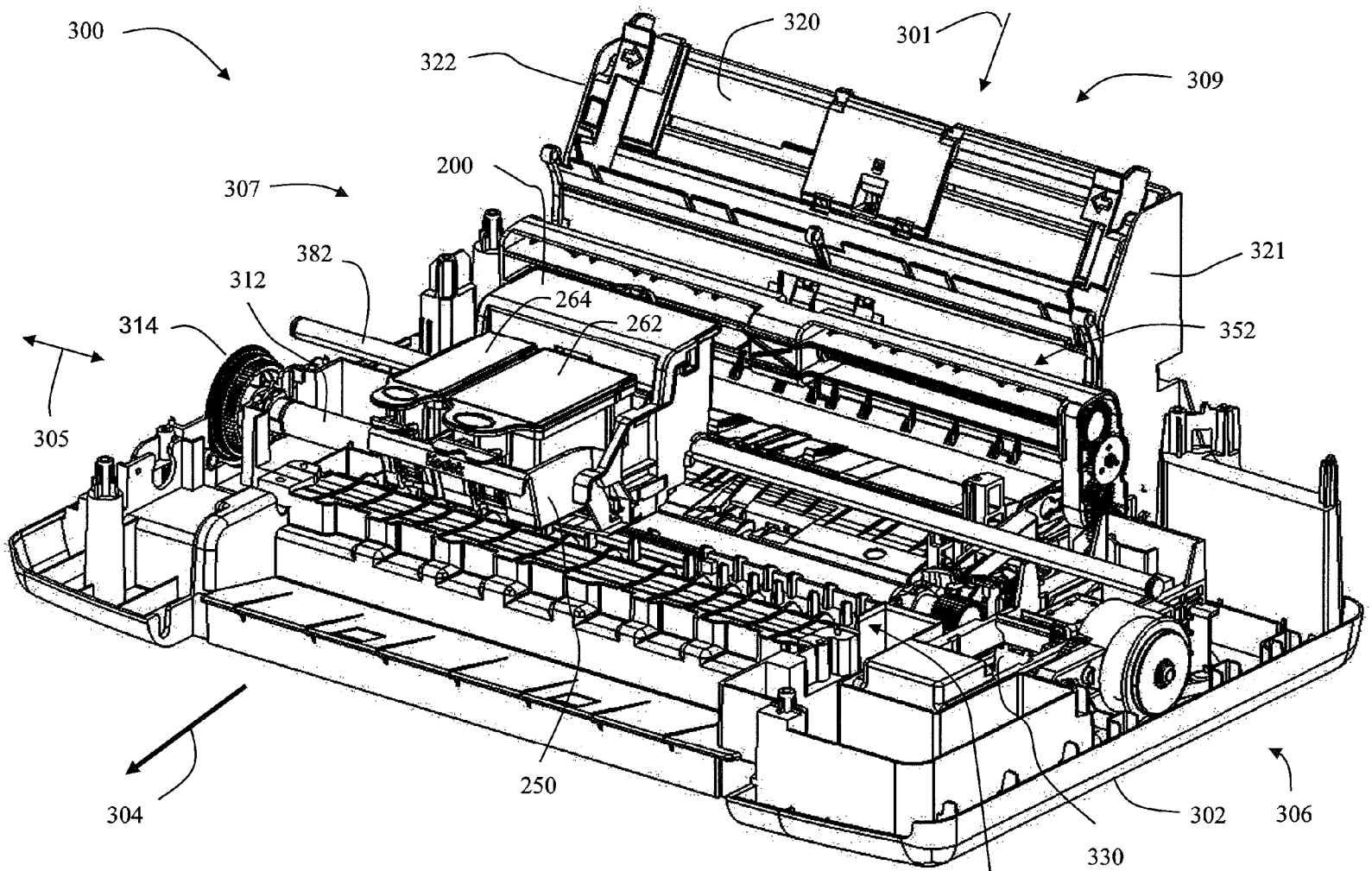
FIG. 3 is a perspective of a portion of printer without a duplexing unit attached.
Figure 4:
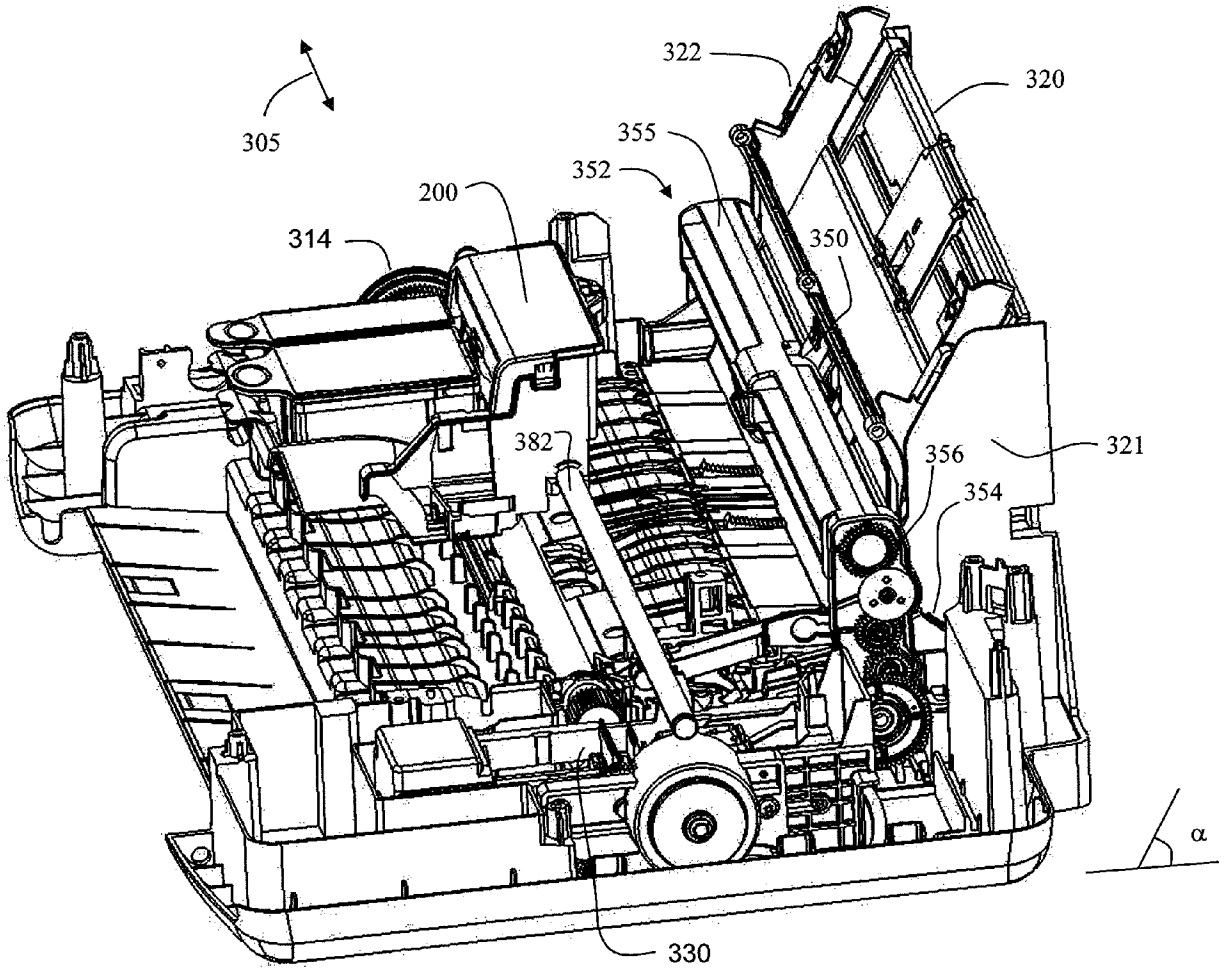
FIG. 4 is a perspective of the printer of FIG. 3 but rotated to show additional features.

FIGS. 3 and 4 show a portion of a desktop carriage printer. Some of the parts of the printer have been hidden in the view shown in FIG. 3 so that other parts can be more clearly seen. A printer body 300 includes a horizontal base 302. The carriage 200 is moved back and forth in a carriage scan direction 305, between a right side 306 and a left side 307 of the printer body 300, while drops 181 and 182 (see FIG. 1) are ejected from the printhead die 251 (not shown in FIG. 3) on the printhead 250 that is mounted on the carriage 200. A carriage motor (not shown) moves the carriage 200 along a carriage guide rail 382.

The printhead 250 is mounted in the carriage 200, and a multi-chamber ink supply 262 and a single-chamber ink supply 264 are mounted in the printhead 250. The mounting orientation of the printhead 250 is rotated relative to the view in FIG. 2 so that the printhead die 251 are located at the bottom side of the printhead 250, the droplets 181 and 182 of ink being ejected downward in the view of FIG. 3. The multi-chamber ink supply 262, for example, contains three ink sources: e.g. cyan, magenta, and yellow ink; while single-chamber ink supply 264 contains black ink. Toward the right side 306 of the printer body 300, in the example of FIG. 3, is a maintenance station 330.

FIG. 4 is a side perspective view (from right side 306 of FIG. 3) of a portion of the inkjet printing system 10 (see FIG. 1) with a pick arm assembly 352 biased to pivot toward a media input support 320. The pick arm assembly 352 includes a pick roller 350, a pick roller support arm 355 and support legs 356 and is biased toward the media input support 320 by a biasing spring 354 located near but beyond a first side 321 of media input support 320. The biasing spring 354 is attached to pivotable support leg 356. The biasing support leg 356 near the first side 321 has a number of gears mounted on it for transmitting rotational motion to the pick roller 350. A second biasing spring (not shown) is located near but beyond a second side 322 of the media input support 320 so that the pick roller 350 is disposed between the two biasing springs 354. The pick roller support arm 355 is substantially parallel to the carriage scan direction 305 and extends beyond the first side 321 and the second side 322 of the media input support 320 in order to provide attachment points for the two biasing springs 354 at the support legs 356 without interfering with the passage of the recording medium 20 (shown in FIG. 1 but not shown in FIG. 5).

Figure 5:
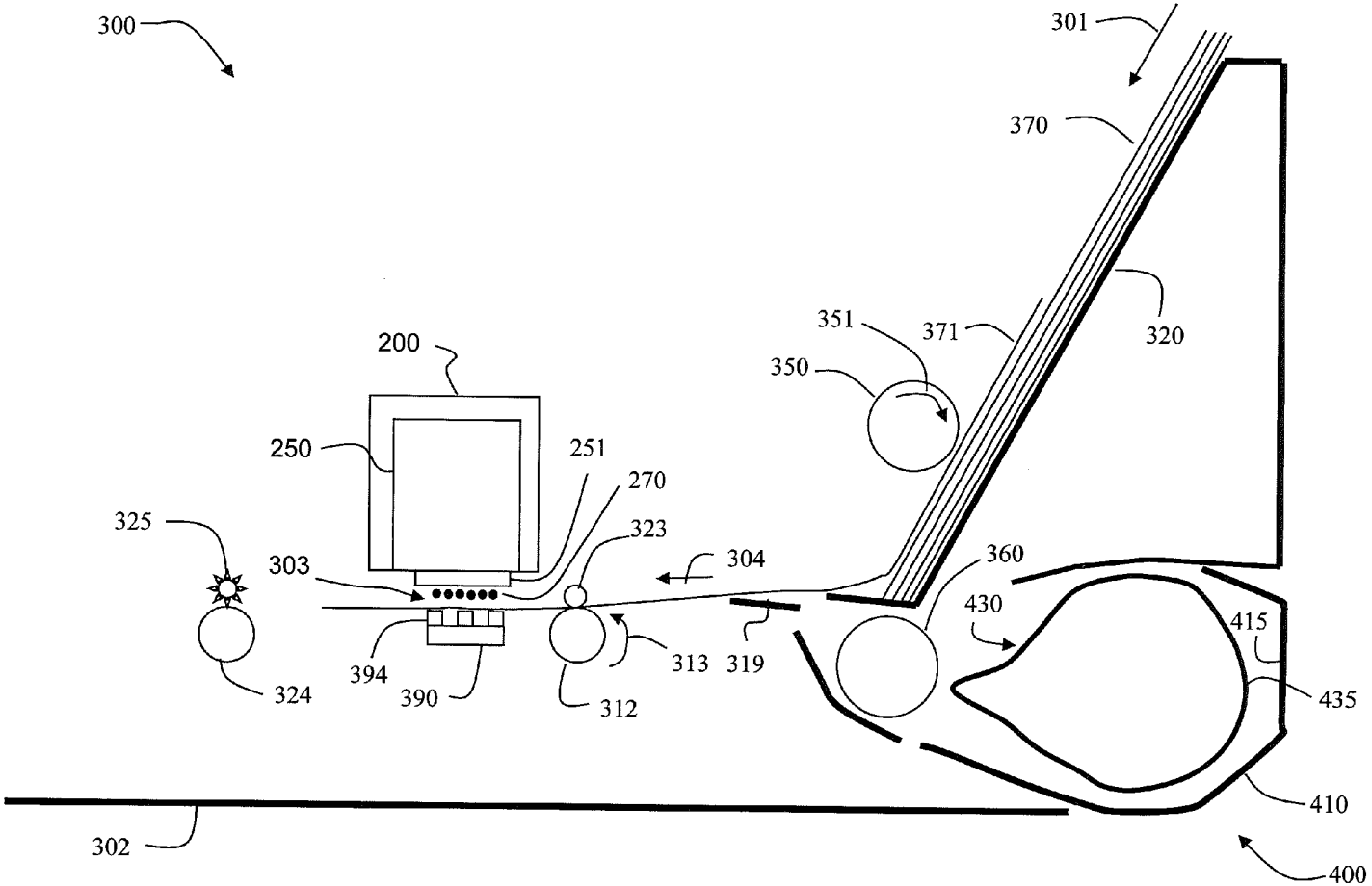
FIG. 5 schematically shows a sheet of recording medium being advanced from a media input holder to a print region.

In the L-shaped paper path shown in FIGS. 3-5, the recording medium 20 is loaded along a paper load entry direction 301 nearly vertically at an angle $\alpha$ of 60 degrees or more relative to the horizontal base 302-against the media input support 320 at the rear 309 of the printer body. The media input support 320 includes the first side 321 and the second side 322. Several rollers are used to advance the recording medium 20 through the printer. The pick roller 350 (FIG. 4) on the pick arm assembly 352 is rotated in a rotation direction 351 to move a first sheet 371 of a stack 370 of the recording medium 20 in the media input support 320 from a paper load entry direction 301 to a media advance direction 304. The sheet 371 pushes down a gate 319 on its way toward a feed roller 312. The sheet 371 is then moved by the feed roller 312 (as it is rotated in a forward rotation direction 313) and idler roller(s) 323 to advance toward a print region 303 (disposed along the carriage scan direction 305). Because the pick roller 350 contacts a top side of the sheet 371 of the recording medium 20 and the feed roller 312 contacts the opposite side, the rotation direction 351 of the pick roller 350 is opposite a forward rotation direction 313 of the feed roller 312 in order to advance the sheet 371 of recording medium 20 toward the print region 303. The feed roller 312 is driven directly by a paper advance motor (not shown) that is connected by a belt or gear engagement, for example at a drive gear 314. A platen 390 supports the sheet 371 at the print region 303. In order to facilitate the printing of borderless prints where the image is printed to the edges of the recording medium 20, the platen 390 can have support ribs 394 in between which is disposed an absorbent medium (not shown) to catch the ink drops 270 that are oversprayed beyond the edges of the recording medium 20. After the image is printed at the print region 303, the sheet 371 of the recording medium 20 is further advanced to the discharge roller 324 and star wheel(s) 325. If the sheet 371 is only to be printed on one side, the discharge roller 324 continues to advance the sheet 371 along the media advance direction 304 toward a media output holder (not shown).

Figure 6:
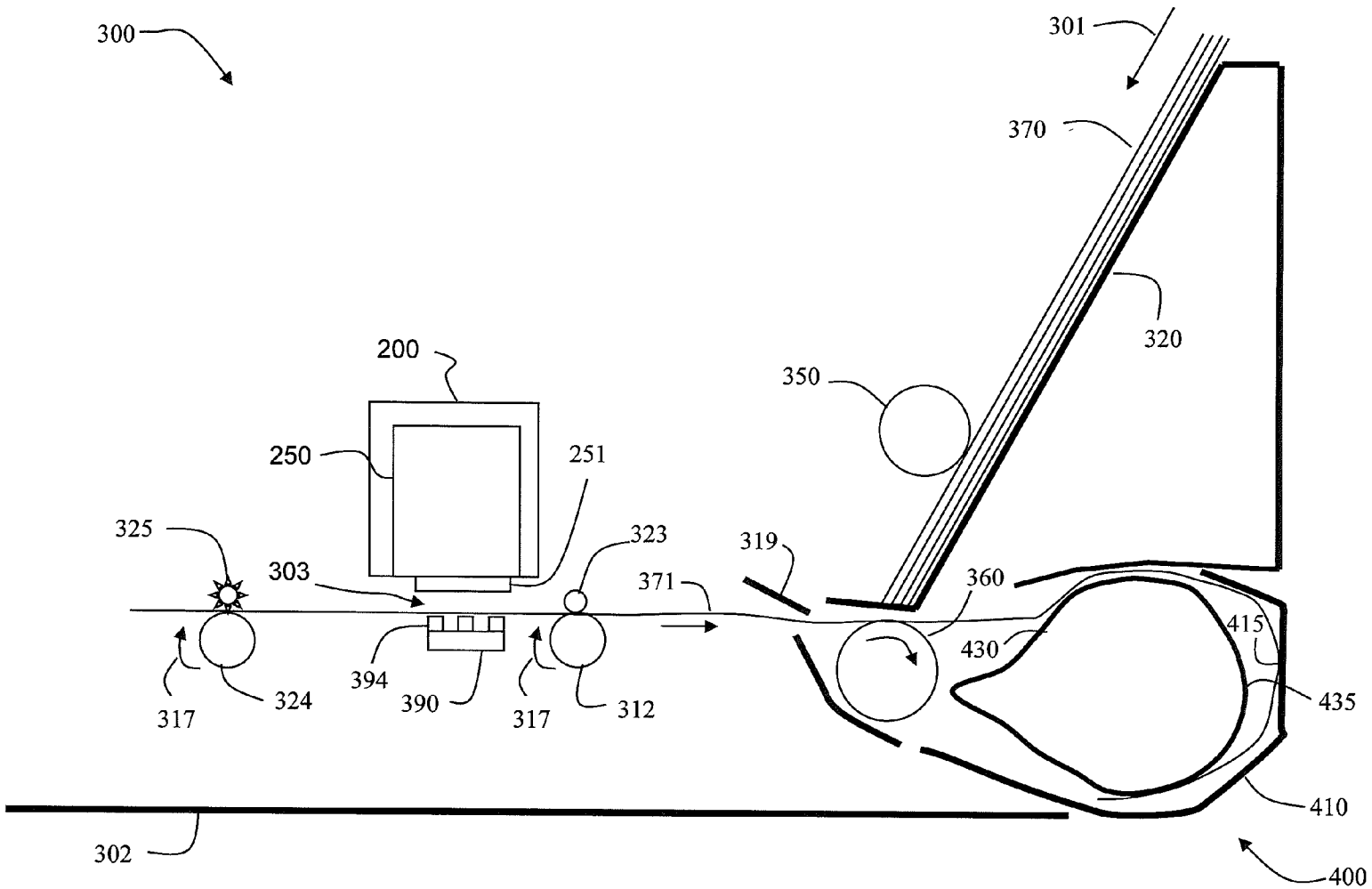
FIG. 6 schematically shows the sheet of recording medium of FIG. 5 being moved from the print region into a duplexing unit.
Figure 7:
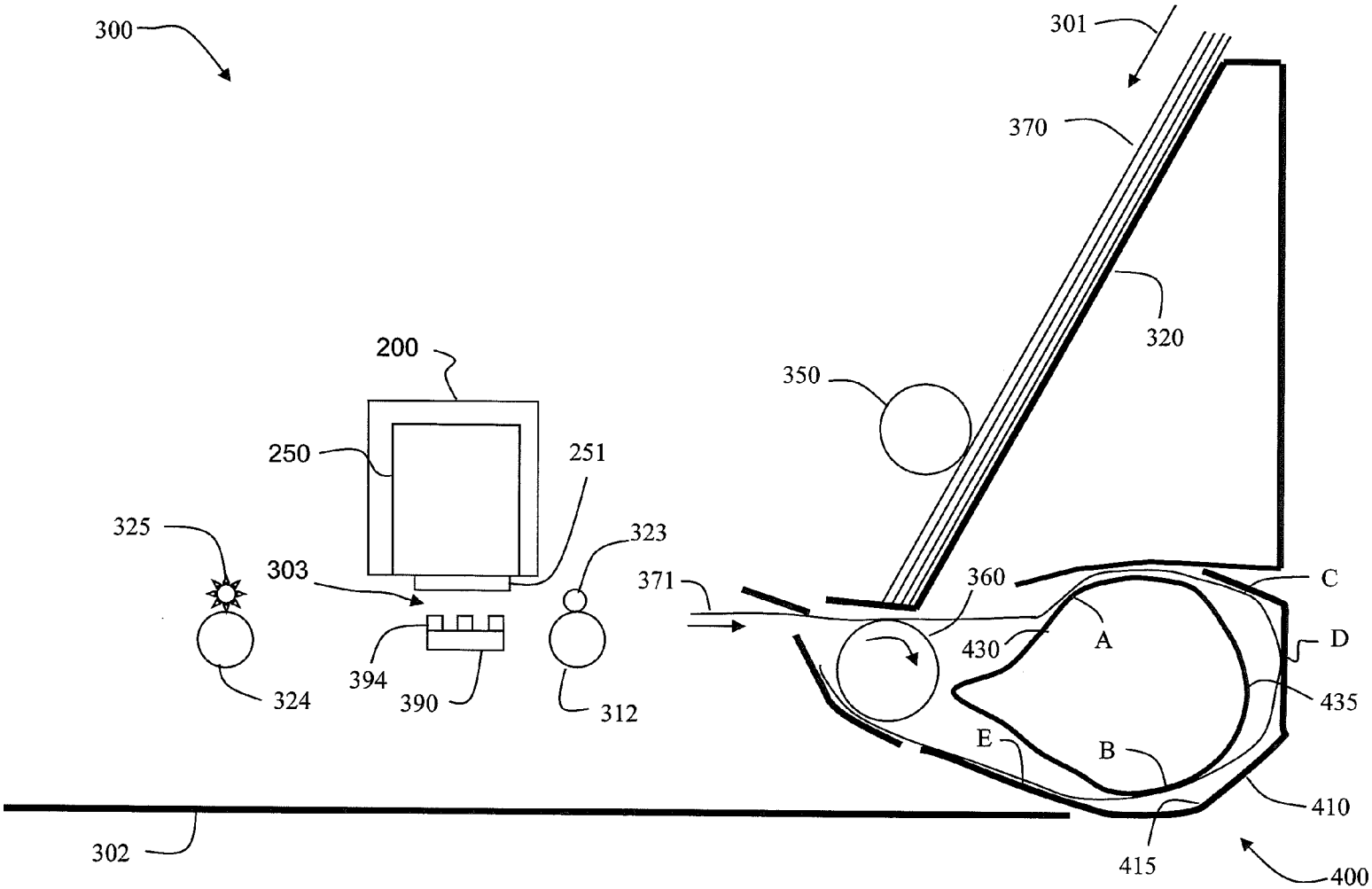
FIG. 7 schematically shows the sheet of recording medium of FIG. 6 being moved through the duplexing unit.

Also shown in FIGS. 5-7 is a duplexing unit 400 for reversing an orientation of the sheet 371, so that the second side can be printed on. The duplexing unit 400 includes an outer member 410 having an inner surface 415. Housed within the outer member 410 is an inner member 430 having an outer surface 435, such that a duplexing path is provided between the inner surface 415 of the outer member 410 and the outer surface 435 of the inner member 430. The inner surface 415 of the outer member 410 and the outer surface 435 of the inner member 430 act as media guides within the duplexing unit 400. As shown in FIG. 6, after printing on the top side of the sheet 371, the discharge roller 324 and the feed roller 313 are rotated in a reverse direction 317 (see FIG. 6) to move the sheet 371 toward the duplexing unit 400. In the example shown in FIG. 6, a duplexing roller 360 is provided within the printer body 300 between the feed roller 312 and the duplexing unit 400. Power for the duplexing roller 400 is provided by the same motor (not shown) that provides rotational power to the pick roller 350 and the feed roller 312. The duplexing roller-360 moves the sheet 371 into and through the duplexing unit 400. On its way to enter the duplexing unit 400, the sheet 371 passes below a gate 319 and then contacts an upper portion of the driven duplexing roller 360. In the example shown in FIG. 7, as the sheet 371 continues through the duplexing unit 400 it contacts the outer surface 435 of the inner member 430 at contact points A and B, and it contacts the inner surface 415 of the outer member 410 at contact points C, D and E. Then, as the sheet 371 exits the duplexing unit 400, a lead edge of the sheet 371 reaches the lower portion of the driven duplexing roller (or wheel) 360, which helps to pull the sheet 371 through the duplexing unit 400 and move it toward the feed roller 312. The nonprinted side now faces the printhead die 251 when the feed roller 312 (rotating in the forward direction 313 again as in FIG. 5) moves sheet 371 through the print region 303.

Figure 8:
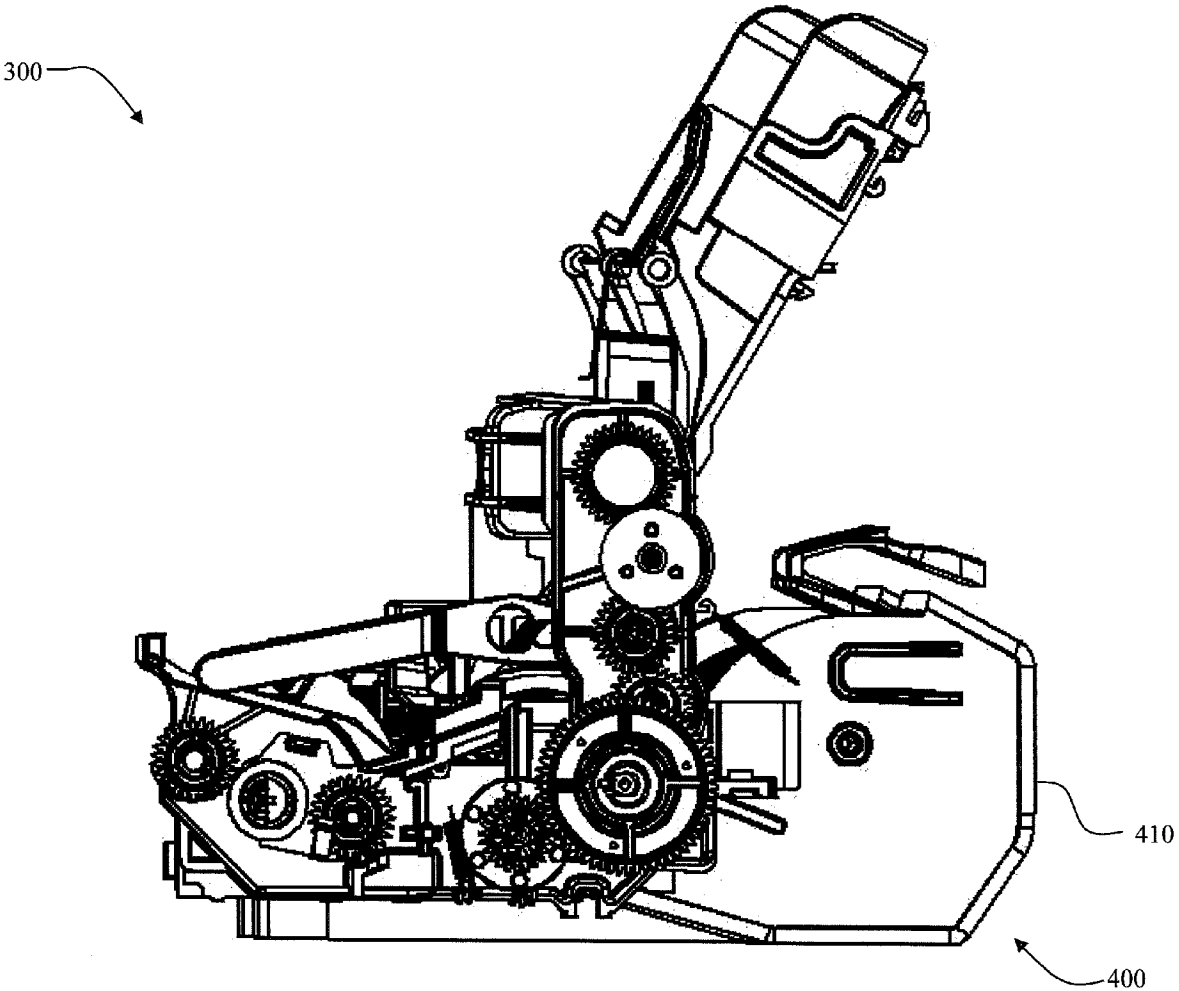
FIG. 8 is a side perspective of a portion of an inkjet printer with a duplexing unit attached.
Figure 9:
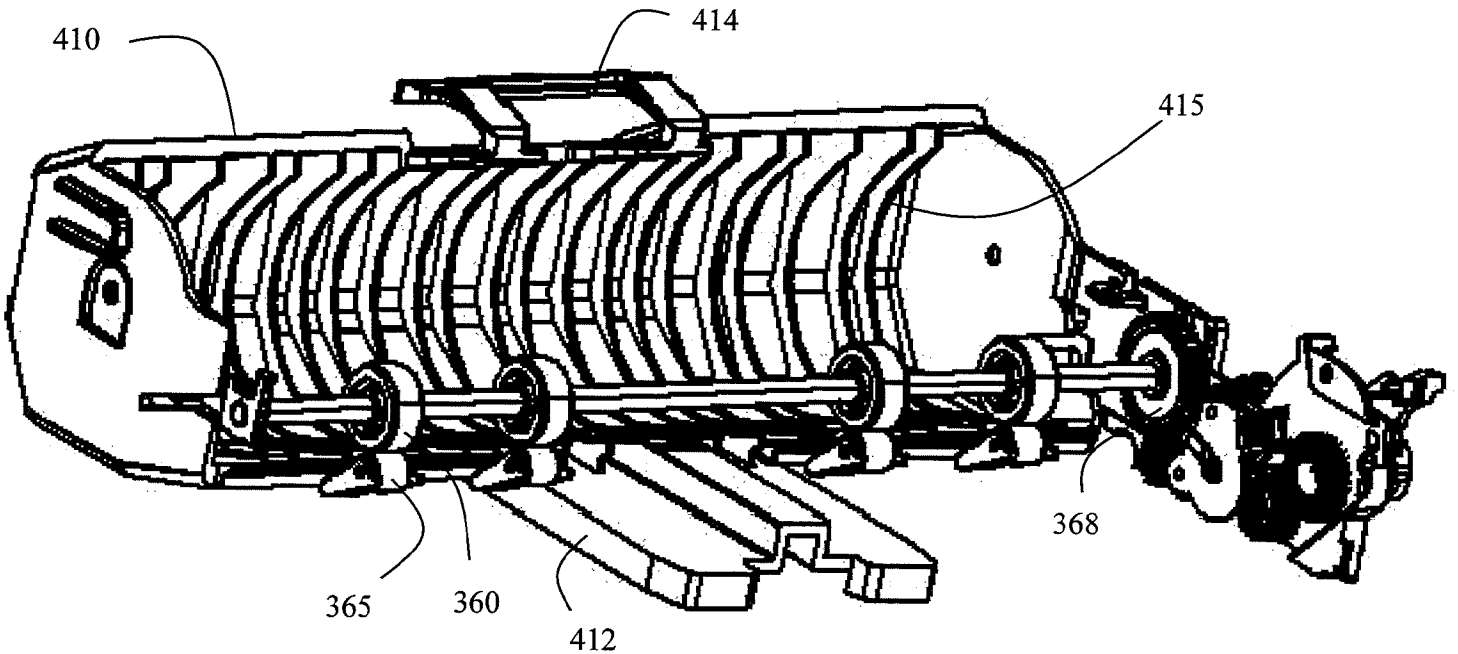
FIG. 9 is a perspective of an outer member of a duplexing unit next to a set of duplexing wheels.

FIG. 8 shows a perspective of a portion of the printer body 300 with the duplexing unit 400 attached at the rear. FIG. 9 shows an example of the outer member 410 as viewed from the side of the inner surface 415. A slide member 412 is an attachment member for attaching the duplexing unit 400 to the printer body 300, and a handle 414 facilitates the removal of the duplexing unit 400 for clearing paper jams. Four smaller duplexing rollers 360 (in contrast to the larger duplexing roller 360 of FIGS. 5-7) are shown next to pinch rollers 365 for moving the paper through the duplexing unit 400. The duplexing rollers 360 are driven by the paper advance motor (not shown) through gears including a gear 368.

An important emphasis of the embodiments of the present invention is to reduce the tendency of thicker media, such as photo media, to bind and cause paper jams while passing through the duplexing unit 400. This is done by reducing the amount of friction between the sheet 371 and the inner member 430 at contact points such as A and B, and between the sheet 371 and the outer member 410 at contact points such as C, D and E.

In a first embodiment, friction is reduced by providing the inner surface 415 of the outer member 410 with a kinetic coefficient of friction that is lower than for conventional duplexing units and is between 0.05 and 0.30, and preferably between 0.05 and 0.20. The kinetic coefficient of friction is defined as the ratio of the force required to move one surface over another to the total force applied normal to those surface while motion is in progress. Conventional duplexing units have the outer member 410 and the inner member 430 formed by injection molding of plastic. A typical injection molded plastic is Noryl which is a blend of polyphenylene oxide and polystyrene. Noryl has a kinetic coefficient of friction of about 0.39. In order to reduce the kinetic coefficient of friction of the inner surface 415 of the outer member 410, one can surface treat the inner surface 415. Alternatively, one can use a low friction plastic including a fluorocarbon, for example, when injection molding the outer member 410. In some embodiments a low friction film 420 (see exploded view of FIG. 10) is affixed to the outer member 410 to cover the inner surface 415. The film 420 can be made of a variety of materials, including metal shim stock, but in a preferred embodiment the film 420 is a polymer film. Polyethylene is one example of a of suitable polymer film Films containing a fluorocarbon, such as polytetrafluoroethylene (Teflon), are also known to have very low kinetic coefficients of friction. (A standard test method for static and kinetic coefficients of friction of plastic film is provided by ASTM Standard D 1894.) In some embodiments, the polymer film 420, such as a polyethylene film, includes an antistatic agent. Such an antistatic agent can dissipate static and can also make the film surface more slippery. In order to conform to the curved inner surface 415 of the outer member 410 a thickness of the film 420 is typically between 0.05 mm and 0.2 mm. The low friction film 420 lining the inner surface 415 of the outer member 410 helps to reduce binding and paper jams by reducing friction at contact points such as C, D and E in FIG. 7.

In another embodiment, the outer surface 435 of the inner member 430 (FIG. 7) can be provided with a kinetic coefficient of friction that is between 0.05 and 0.30. As described above relative to the inner surface 415 of the outer member 410, one can surface treat the outer surface 435, or use a low friction plastic including a fluorocarbon for example when injection molding the inner member 430, or affix the low friction film 420 (FIG. 10) to the inner member 430 wrapped around outer surface 435. In this way, binding and paper jams are reduced by reducing friction at contact points such as A and B in FIG. 7.

Figure 10:
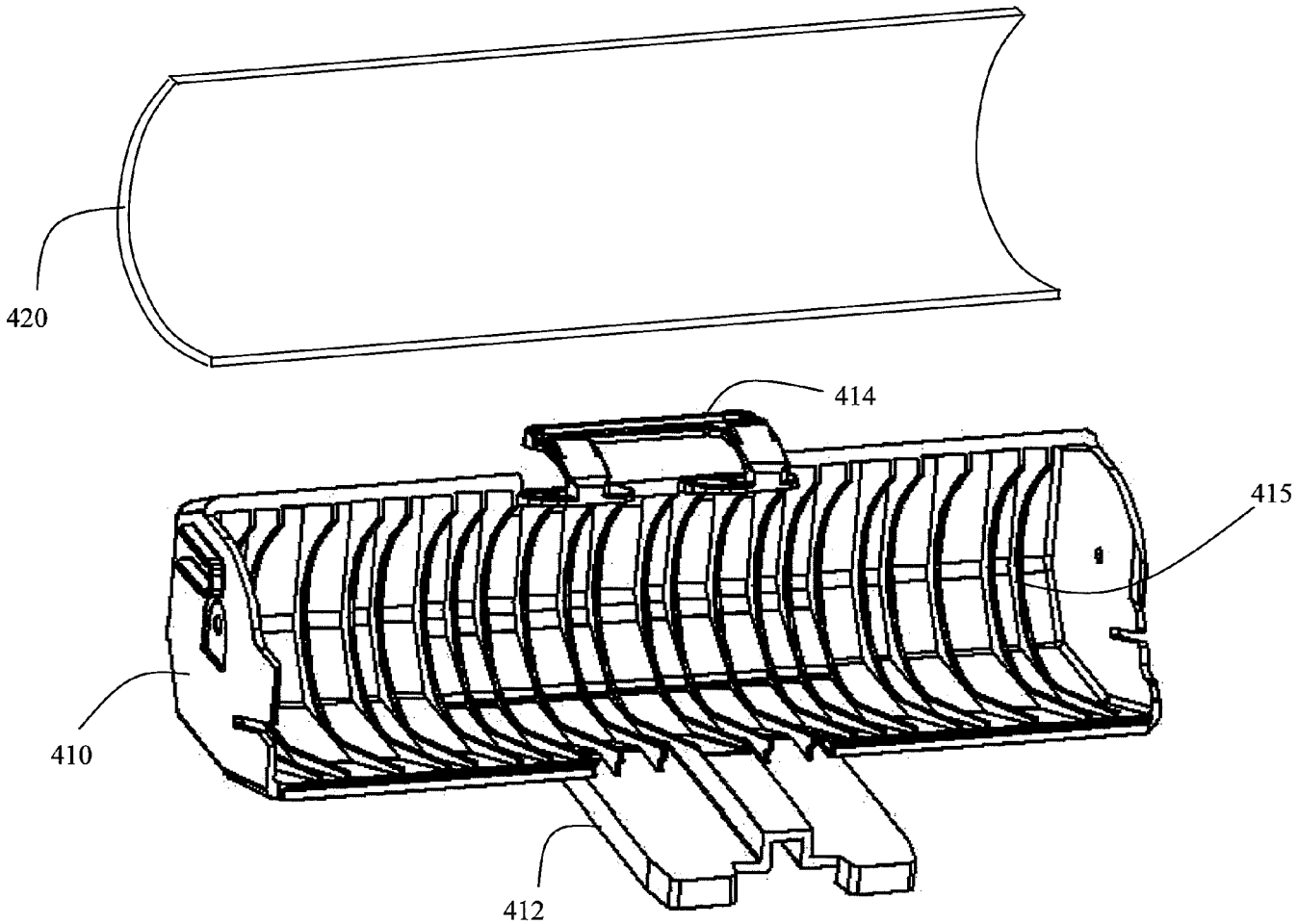
FIG. 10 is an exploded view of a low friction film for lining the inner surface of the outer member of the duplexing unit, according to an embodiment of the invention.
Figure 11:
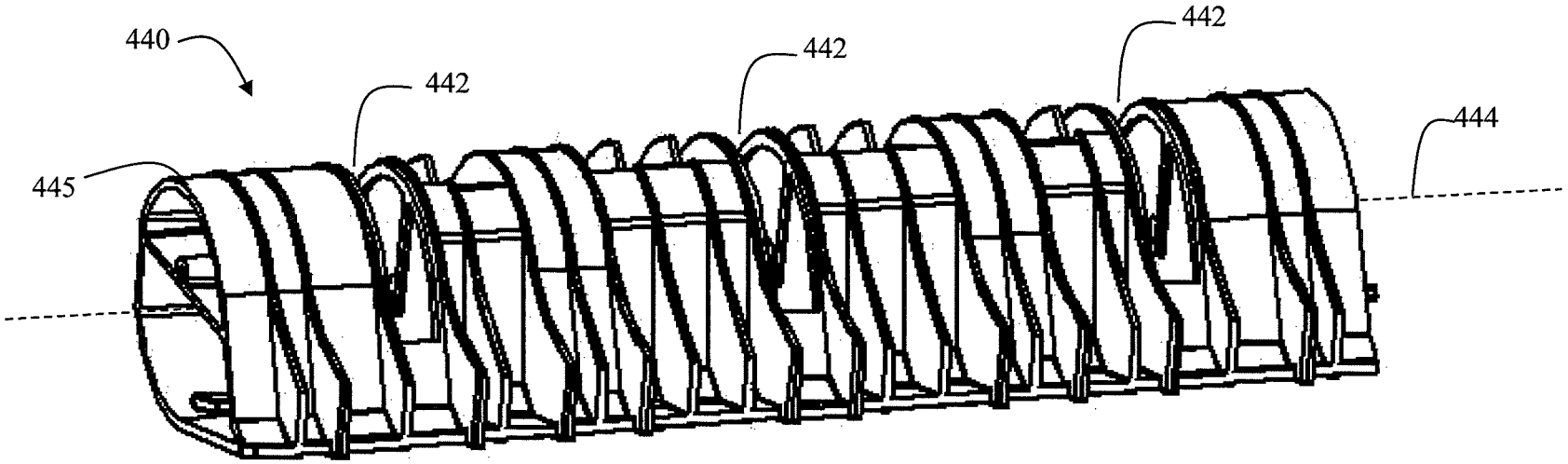
FIG. 11 is a perspective of a stationary structural element of an inner member of the duplexing unit according to another embodiment of the invention.
Figure 12:
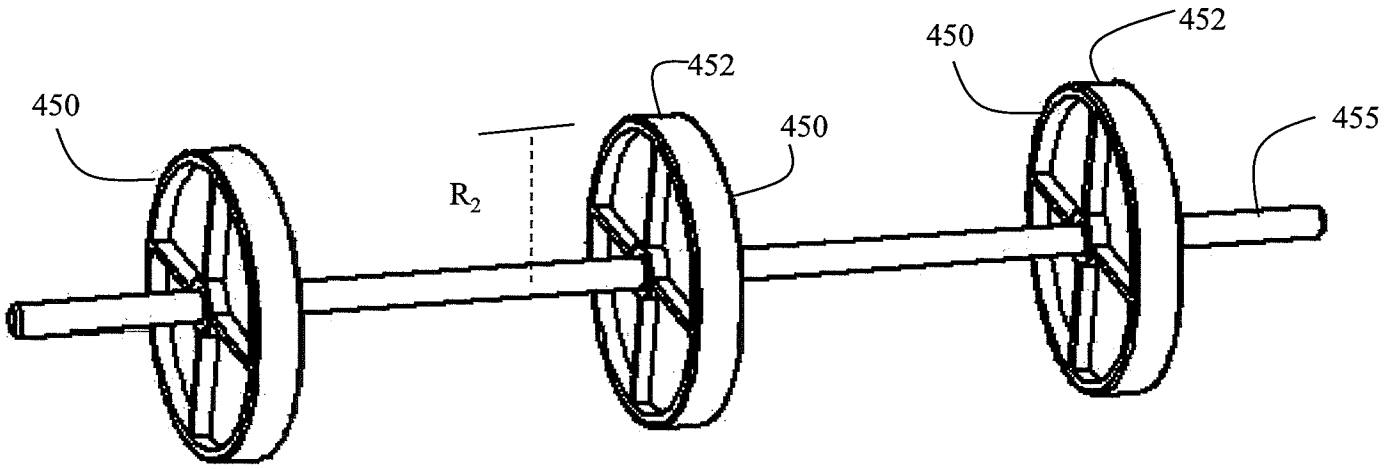
FIG. 12 is a perspective of freely rotating wheels that are to be mounted in the stationary structural element of FIG. 11.
Figure 13:
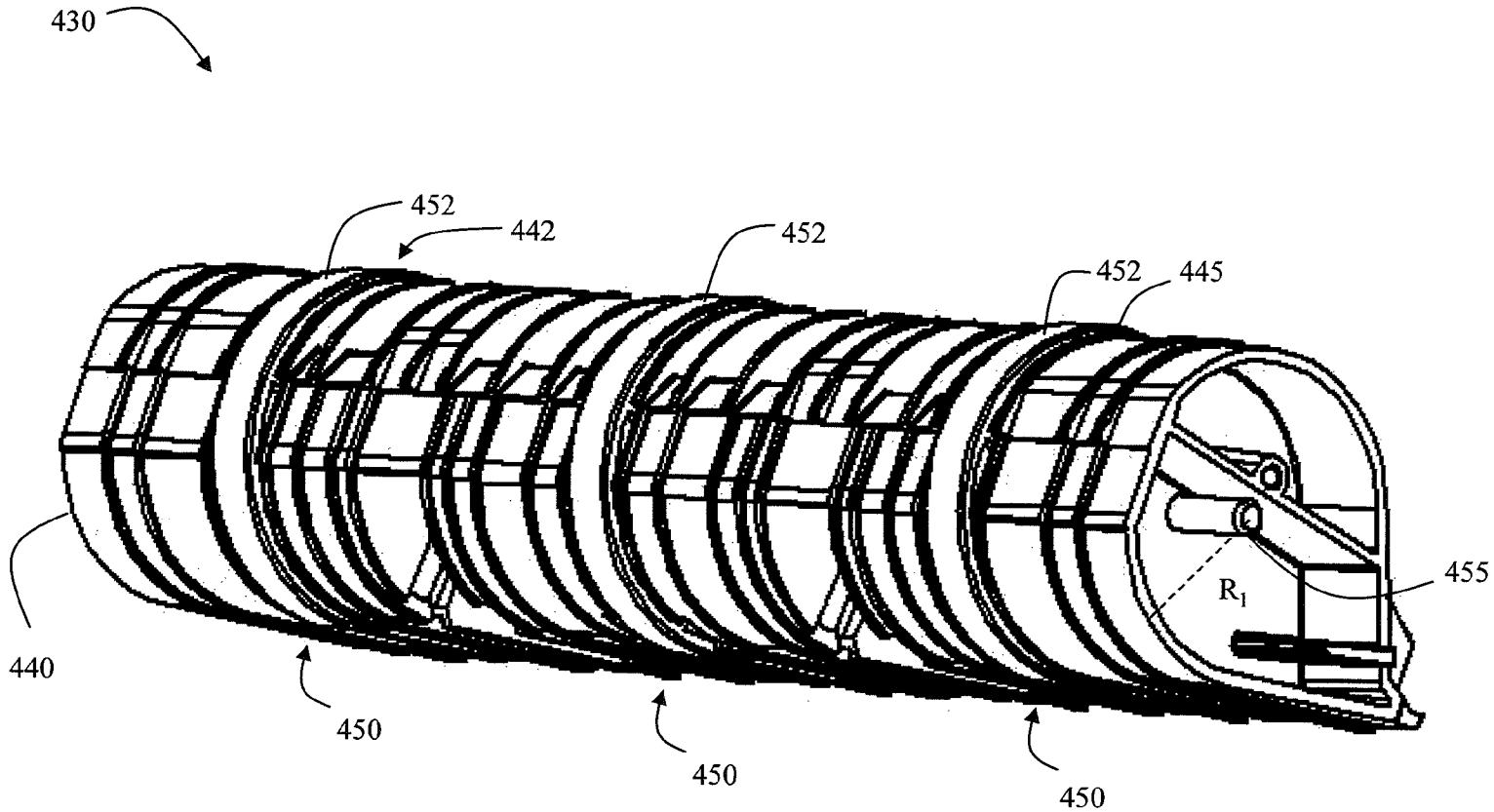
FIGS. 13 and 14 are perspectives of the freely rotating wheels of FIG. 12 mounted in the stationary structural element of FIG. 11.
Figure 14:
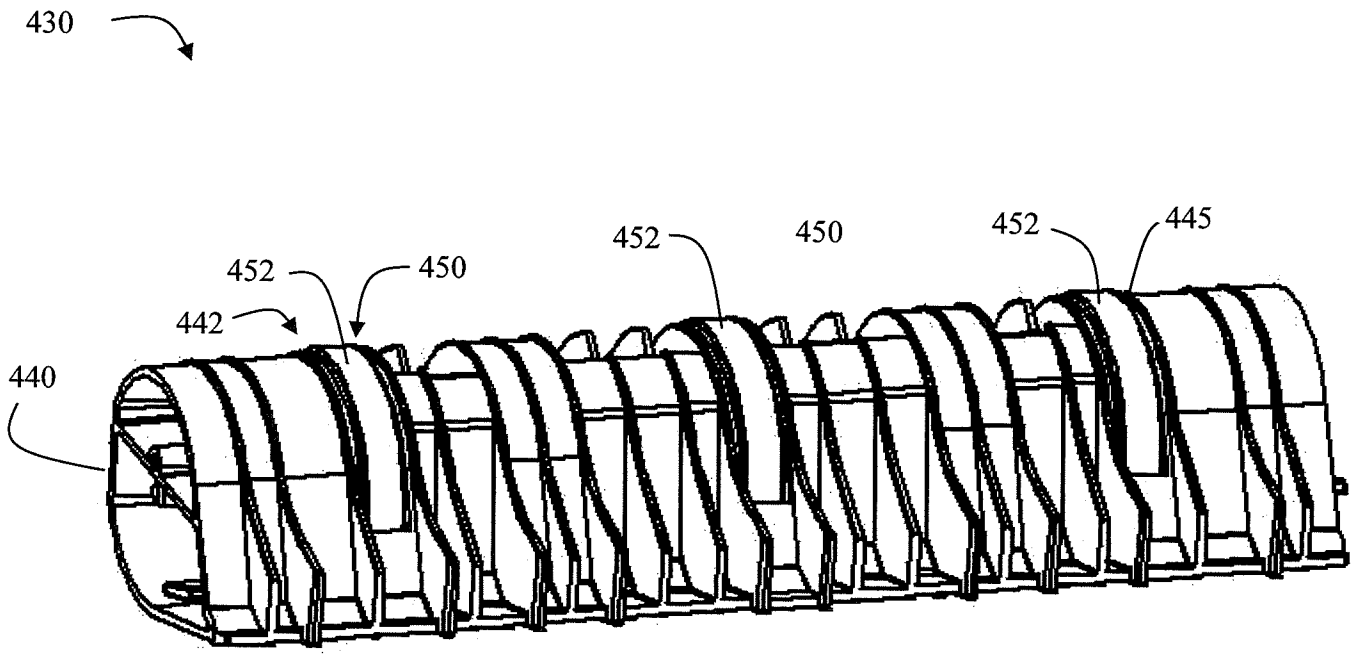
Figure 15:
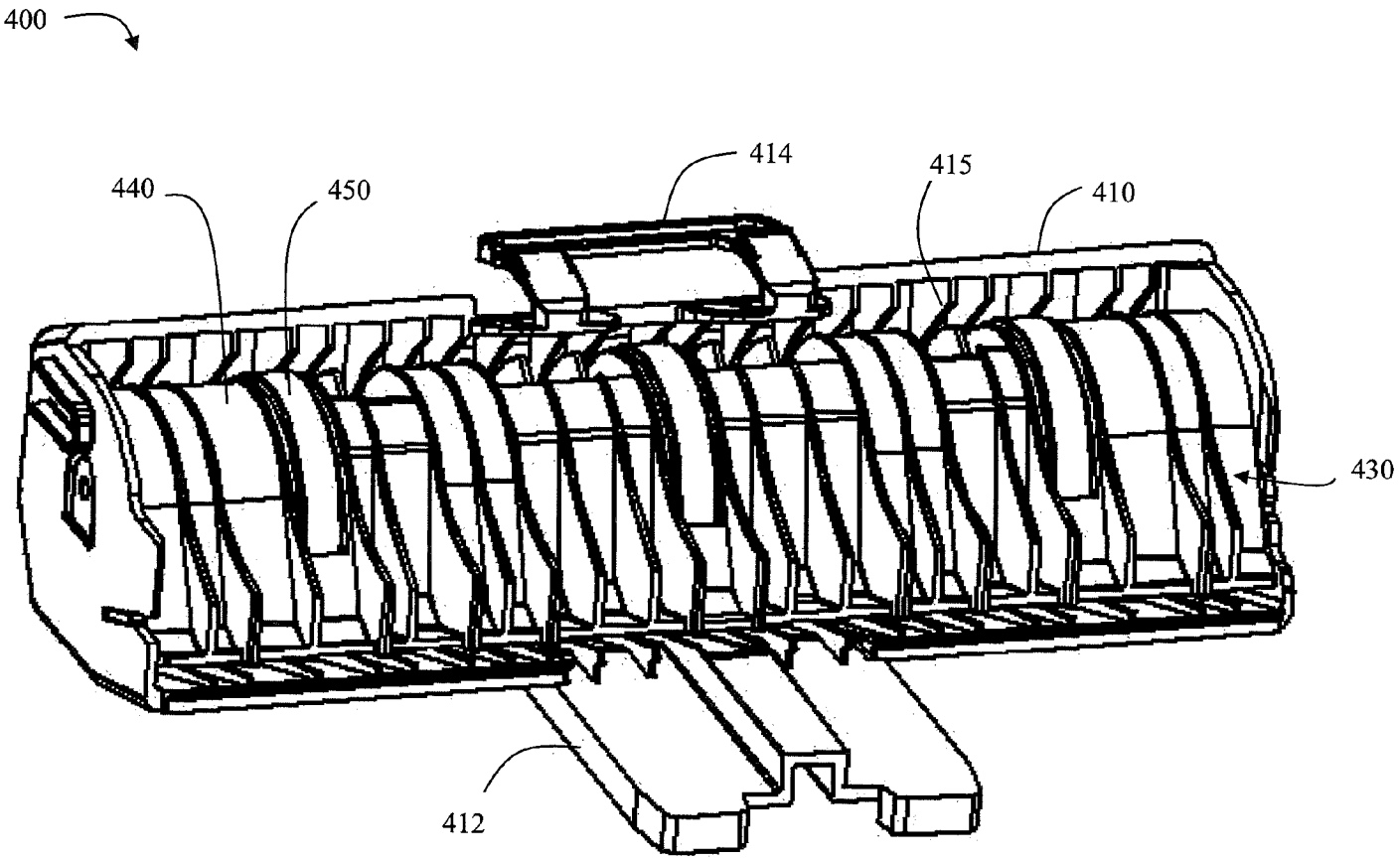
FIG. 15 is a perspective of the stationary structural element and wheels of FIG. 14 housed in the outer member of FIG. 10.

In yet another embodiment shown in FIGS. 11-15 friction at the inner member 430 can be reduced by using the inner member 430 that includes a stationary structural element 440 (FIG. 11) and one or more rotatable elements 450 (typically three rotatable elements), such as rollers or wheels (FIG. 12) that are configured to rotate freely relative to stationary structural element 440. Preferably, the freely rotatable element 450 includes a plurality of wheels that are mounted on an axle 455. In the example shown in FIGS. 11-14, stationary structural element has an outer surface 445 with a radius of curvature $R_1$. The stationary structural element 440 also has three slots 442 (FIG. 11) through which the three rotatable elements 450 extend respectively (FIGS. 13-14). The rotatable elements 450 are mounted on an axle 455 (FIG. 12) that is oriented parallel to an axis 444 (FIG. 11) of the stationary structural element 440. The rotatable elements 450 are not connected by gears or other power transmission device to a motor, so that they are freely rotatable. Each rotatable element 450 has a radius $R_2$ from a center of the rotatable element 450 (concentric with a center of the axle 455) to a contact surface 452 of the wheel. Wheel radius $R_2$ is greater than radius of curvature $R_1$. As a result, with reference to FIGS. 7, 13 and 14, at contact points such as A and B within the duplexing unit 400, the sheet 371 primarily contacts the contact surfaces 452 of the rotatable elements 450 rather than the outer surface 445 of stationary structural element 440 of inner member 430. In other words, in this embodiment the duplexing path is provided between the inner surface 415 of outer member 410 and the contact surfaces 452 of freely rotatable elements 450. When the sheet 371 hits contact surfaces 452 of rotatable element 450 at contact points such as A and B, it causes the rotatable elements 450 to rotate, thereby reducing friction between sheet 371 and inner member 430 and reducing the tendency for the sheet 371 to bind or jam in the duplexing unit 400. FIG. 15 is a perspective from a similar viewpoint as FIGS. 10 and 14 showing the duplexing unit 400 with the inner member 430, which has the stationary structurally element 440 and freely rotating the rotatable elements 450, housed within the outer member 410.

The embodiments described above can be implemented singly or in combination in the duplexing unit 400. For example, in a preferred combination embodiment, the inner member 430 includes a freely rotatable element 450, while the outer element 410 has the inner surface 415 with a coefficient of kinetic friction that is between 0.05 and 0.30, that is provided, for example by a low friction polymer film that lines the inner surface 415.

The present invention has been described in detail with particular reference to certain preferred embodiments thereof, but it will be understood that variations and modifications can be effected within the spirit and scope of the invention.

PARTS LIST

10 Inkjet printer system
12 Image data source
14 Controller
15 Image processing unit
16 Electrical pulse source
18 First fluid source
19 Second fluid source
20 Recording medium
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
181 Droplet(s) (ejected from first nozzle array)
182 Droplet(s) (ejected from second nozzle array)
200 Carriage
250 Printhead
251 Printhead die
253 Nozzle array
254 Nozzle array direction
255 Mounting support member
256 Encapsulant
257 Flex circuit
258 Connector board
262 Multi-chamber ink supply
264 Single-chamber ink supply
270 Ink drops
300 Printer body
301 Paper load entry direction
302 Base
303 Print region
304 Media advance direction
305 Carriage scan direction
306 Right side of printer body
307 Left side of printer body
309 Rear of printer body
312 Feed roller
313 Forward rotation direction (of feed roller)
314 Drive gear
317 Reverse rotation direction (of feed roller)
319 Gate
320 Media input support
321 First side
322 Second side
323 Idler roller
324 Discharge roller
325 Star wheel(s)
330 Maintenance station
350 Pick roller
351 Rotation direction
352 Pick arm assembly
354 Biasing spring
355 Support arm
356 Support leg
360 Duplexing roller
365 Pinch roller
368 Gear
370 Stack of media
371 Sheet
382 Carriage guide rail
390 Platen
394 Support ribs
400 Duplexing unit
410 Outer member
412 Slide member
414 Handle
415 Inner surface (of outer member)
420 film
430 Inner member
435 Outer surface (of inner member)
440 Stationary structural element
442 Slot(s)
444 Axis
445 Outer surface (of stationary structural element)
450 Rotatable elements
452 Contact surface (of the rotatable element)
455 Axle
A, B, C, D, E Contact Points
$R_1$ Radius curvature
$R_2$ Radius of rotatable element

The invention claimed is:

1. A printer configured to print in a duplex mode, the printer comprising:

a media input holder;

a pick roller for advancing a sheet of recording medium from the media input holder;

a feed roller for advancing the sheet of recording medium toward a print region when rotating in a forward direction;

a duplexing unit for reversing an orientation of the sheet of recording medium, the duplexing unit comprising:

an outer member including an inner surface; and an inner member that is housed within the outer member, the inner member including:

a stationary structural element having an outer surface with a radius of curvature; and a freely rotatable element having a radius that is larger than the radius of curvature of the stationary structural element, wherein a duplexing path is provided between the inner surface of the outer member and a contact surface of the freely rotatable element;

and a duplexing roller for moving the sheet of recording medium through the duplexing unit, wherein the duplexing roller is disposed between the feed roller and the duplexing unit.

2. The printer of claim 1, wherein the inner member further comprises an axle that is oriented parallel to an axis of the stationary structural element.

3. The printer of claim 2, wherein the freely rotatable element includes a plurality of wheels that are mounted on the axle.

4. The printer of claim 1, wherein the freely rotatable element is a plurality of rotatable elements and the stationary structural element includes a plurality of slots through which the plurality of rotatable elements extend respectively.

5. The printer of claim 1, wherein the inner surface of the outer member has a coefficient of kinetic friction that is between 0.05 and 0.30.

6. The printer of claim 1, wherein the feed roller is configured to move the sheet of recording medium toward the duplexing unit when rotating in a reverse direction.

7. The printer of claim 1, further comprising a motor for providing rotational power to the pick roller, the feed roller and the duplexing roller.

8. The printer of claim 1, wherein the duplexing roller is configured such that the sheet of recording medium contacts an upper portion of the duplexing roller when the sheet enters the duplexing unit, and contacts a lower portion of the duplexing roller when the sheet exits the duplexing unit.

9. The printer of claim 1, wherein the outer member of the duplexing unit includes an attachment member for attaching the duplexing unit to a body of the printer.

* * * * *